US009637331B2

(12) United States Patent
Iwama

(10) Patent No.: US 9,637,331 B2
(45) Date of Patent: May 2, 2017

(54) IMAGE FORMING APPARATUS

(71) Applicant: Brother Kogyo Kabushiki Kaisha, Nagoya-shi, Aichi-ken (JP)

(72) Inventor: Noritaka Iwama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/840,191

(22) Filed: Aug. 31, 2015

(65) Prior Publication Data

US 2016/0289015 A1 Oct. 6, 2016

(30) Foreign Application Priority Data

Mar. 31, 2015 (JP) ..... 2015-073412

(51) Int. Cl.
*B65H 1/00* (2006.01)
*B65H 1/26* (2006.01)

(52) U.S. Cl.
CPC ..... *B65H 1/266* (2013.01); *B65H 2402/61* (2013.01); *B65H 2403/513* (2013.01); *B65H 2403/531* (2013.01); *B65H 2403/541* (2013.01); *B65H 2405/114* (2013.01)

(58) Field of Classification Search
CPC ..... B65H 1/266; B65H 2403/541; B65H 2403/513
See application file for complete search history.

(56) References Cited

U.S. PATENT DOCUMENTS

| | | | | |
|---|---|---|---|---|
| 5,004,217 | A * | 4/1991 | Kano | B65H 1/04 271/10.11 |
| 5,564,690 | A | 10/1996 | Oshida | |
| 2006/0140694 | A1 | 6/2006 | Yano | |
| 2006/0237898 | A1 | 10/2006 | Mizobe | |
| 2007/0001370 | A1 | 1/2007 | Konishi | |
| 2013/0285317 | A1 | 10/2013 | Ishikura | |

FOREIGN PATENT DOCUMENTS

| | | | |
|---|---|---|---|
| JP | H02-080637 | U | 6/1990 |
| JP | H07-157106 | A | 6/1995 |
| JP | H10-139182 | A | 5/1998 |
| JP | 2006-154557 | A | 6/2006 |
| JP | 2006-327823 | A | 12/2006 |
| JP | 2007-008684 | A | 1/2007 |
| JP | 2013-227129 | A | 11/2013 |
| JP | 2014-108852 | A | 6/2014 |

* cited by examiner

*Primary Examiner* — Howard Sanders
(74) *Attorney, Agent, or Firm* — Banner & Witcoff, Ltd.

(57) ABSTRACT

An image forming apparatus including a movement mechanism includes a first arm assembly including a first arm configured to pivot about a first pivot axis between a retracted position and a protruding position, the first arm being biased toward the protruding position and extending away from the first pivot axis in a first direction and a second arm configured to rotate between a restriction position in which the second arm engages the first arm, and a releasing position in which the second arm is separated from the first arm, the second arm configured to rotate from the restriction position to the releasing position in a direction away from the first arm, and a guide including a guide surface extending in the first direction, the guide surface configured to contact the first arm situated in the protruding position and a protruding guide configured to contact and move the second arm.

23 Claims, 11 Drawing Sheets

IMAGE FORMING APPARATUS

CROSS-REFERENCE TO RELATED APPLICATION

This application claims priority from Japanese Patent Application No. 2015-073412 filed on Mar. 31, 2015, the content of which is incorporated herein by reference in its entirety.

BACKGROUND

Generally, an image forming apparatus includes a casing including an opening portion formed at a side surface thereof (e.g., in a width direction), and a sheet supply tray configured to be attached to or installed in an interior of the casing via the opening portion. The sheet supply tray is configured to accommodate a stack of a plurality of sheets and to move between an installed position in which the sheet supply tray is installed in the casing and a pulled position in which the sheet supply tray is pulled out from the installed position.

When the image forming apparatus performs an image forming operation, sheets in the sheet supply tray are fed one by one by a pickup roller to a sheet feeding path inside the casing. Each of the sheets is fed by feeding rollers to an image forming unit for image formation. After the image forming unit forms images onto the sheets, the sheets are discharged onto a discharge tray.

To load a stack of sheets into the sheet supply tray or to change a sheet size, a user manually removes and installs the sheet supply tray relative to the casing.

When the sheet supply tray is manually moved in an inserting direction in which the sheet supply tray is inserted into the casing to install the sheet supply tray therein, the sheet supply tray may be insufficiently inserted, and therefore does not reach an installed position in the casing.

In such a case, improper image formation onto a sheet or sheet feeding problems may occur.

SUMMARY

Accordingly, increasing the ease of operation for installing the sheet supply tray is desired.

DETAILED DESCRIPTION

An illustrative embodiment will be described with reference to the accompanying drawings.

Hereinafter, description will be made with reference to directions that are defined in conjunction with an orientation in which a user uses an image forming apparatus, e.g., a laser printer 1. More specifically, description will be made with reference to a top-bottom direction, a front-rear direction and a left-right direction, as depicted in FIGS. 1-7 with arrows.

[General Structure of Laser Printer (Image Forming Apparatus) 1]

First, a general structure of the laser printer 1 according to an illustrative embodiment will be described referring to FIGS. 1-3.

Figure 1:
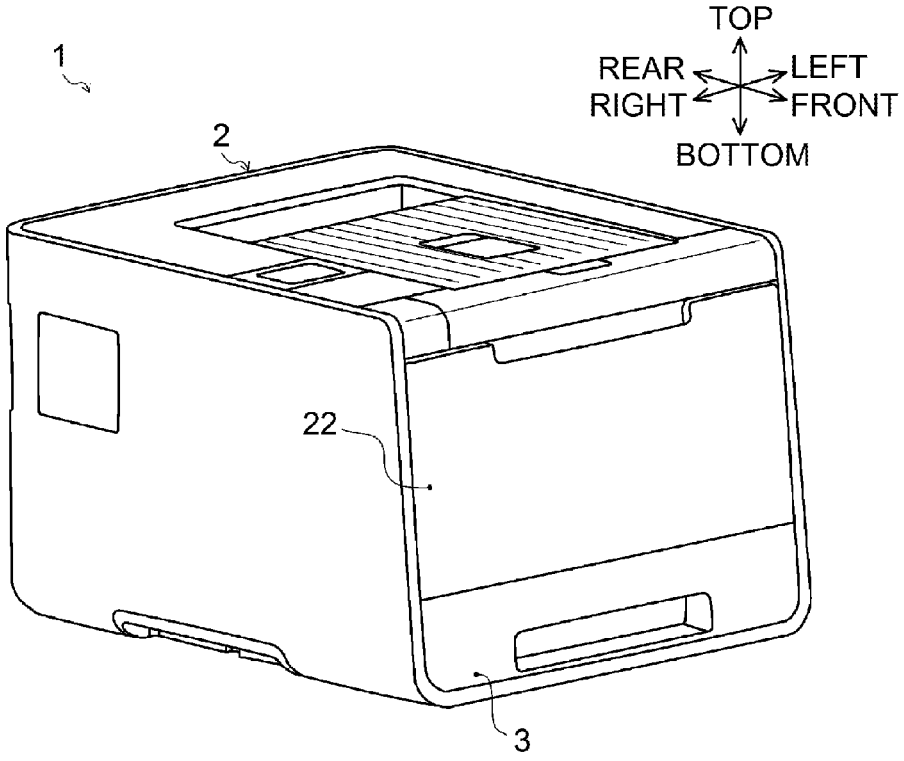
FIG. 1 is an external perspective view of a laser printer in an illustrative embodiment according to one or more aspects of the disclosure.

As depicted in FIG. 1, the laser printer 1 includes a box-shaped casing 2. A discharge tray 21 is provided at an upper surface of the casing 2. A recording sheet S having an image formed thereon is discharged onto the discharge tray 21. A front cover 22 pivotable in the counterclockwise direction in FIG. 2 is disposed at a front surface of the casing 2. The front cover 22 is opened and closed, for example, as a process cartridge 52 is replaced.

A sheet supply tray 3 configured to receive a stack of recording sheets S is disposed below the front cover 22. The sheet supply tray 3 is configured to be removed and inserted through a front surface of the casing 2 along a rail 23 (depicted in FIG. 3). The rail 23 extends in a front-to-rear direction, according to the orientation shown in FIG. 1.

Structures of the sheet supply tray 3 will be described.

Figure 2:
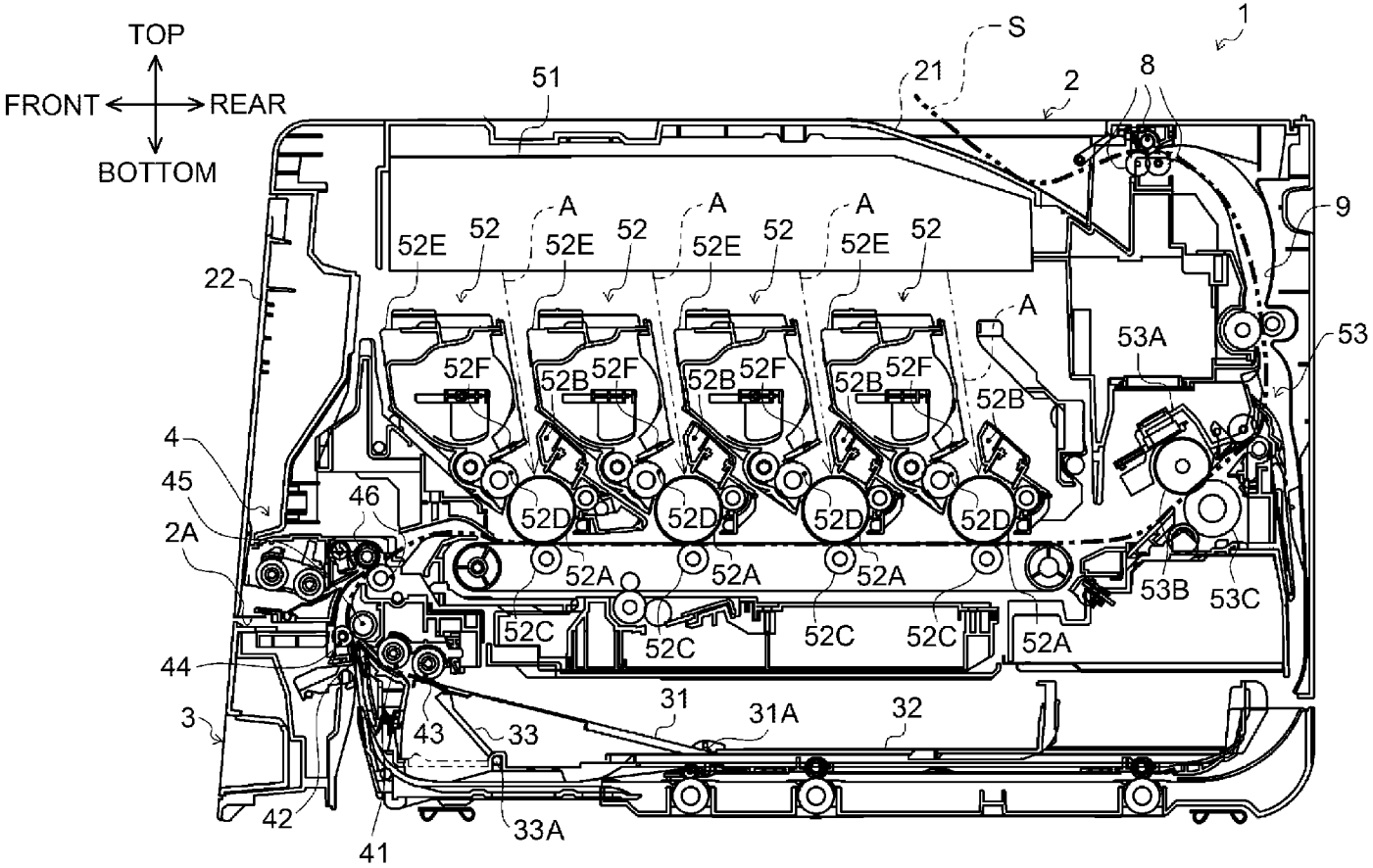
FIG. 2 is a sectional side view of the laser printer, illustrating a general structure thereof.

As depicted in FIG. 2, the sheet supply tray 3 is disposed at a lower portion of the casing 2. The sheet supply tray 3 is configured to be situated in an installed position and a pulled (e.g., non-installed) position. In the installed position, the sheet supply tray 3 is installed in a tray accommodating portion 2A that is open at a lower front portion of the casing 2. In the pulled position, at least a portion of the sheet supply tray 3 is pulled out from the casing 2. For example, the sheet supply tray 3 may be partially or fully pulled from the casing 2 in the pulled position. A direction in which the sheet supply tray 3 is moved from the pulled position to the installed position may, in one example, correspond to an inserting direction (e.g., a front-to-rear direction or a direction of an arrow X in FIG. 3).

A lift plate 31 configured to receive a plurality of recording sheets S is disposed within the sheet supply tray 3. The lift plate 31 is pivotally supported about a third pivot axis, e.g., an axis of a shaft 31A disposed at a rear end portion of the lift plate 31, which is a downstream end portion of the lift plate 31 in the inserting direction. The lift plate 31 is configured to move between a loading position and a supply position. In the loading position, the lift plate 31 is parallel to or along a bottom plate 32 of the sheet supply tray 3 as a front end portion of the lift plate 31, which is an upstream end portion in the inserting direction, is disposed lower than in the supply position. In the supply position, the lift plate 31 is inclined with its front end portion positioned higher as compared with the front end portion of the lift plate 31 situated in the loading position.

A lever 33 configured to raise the front end portion of the lift plate 31 is disposed in the sheet supply tray 3. The lever 33 is pivotally supported below a front portion of the lift plate 31 about a lever shaft 33*a* disposed at a rear end portion of the lever 33. The lever 33 is configured to move between a resting position and an inclined position. In the resting position, the lever 33 is parallel to or along the bottom plate 32 of the sheet supply tray 3. In the inclined position, a front end portion of the lever 33 is moved up away from the bottom plate 32 so as to raise the lift plate 31.

The lever 33 is configured to rotate about the lever shaft 33*a* in a clockwise direction in FIG. 2, as a drive force is input from a motor (not depicted) disposed in the laser printer 1 to the lever 33. Thus, the front end portion of the lever 33 raises the lift plate 31 to the supply position.

When the sheet supply tray 3 is pulled out from the casing 2, the lift plate 31 is situated in the loading position as the front end portion of the lift plate 31 moves down by its own weight.

Figure 3:
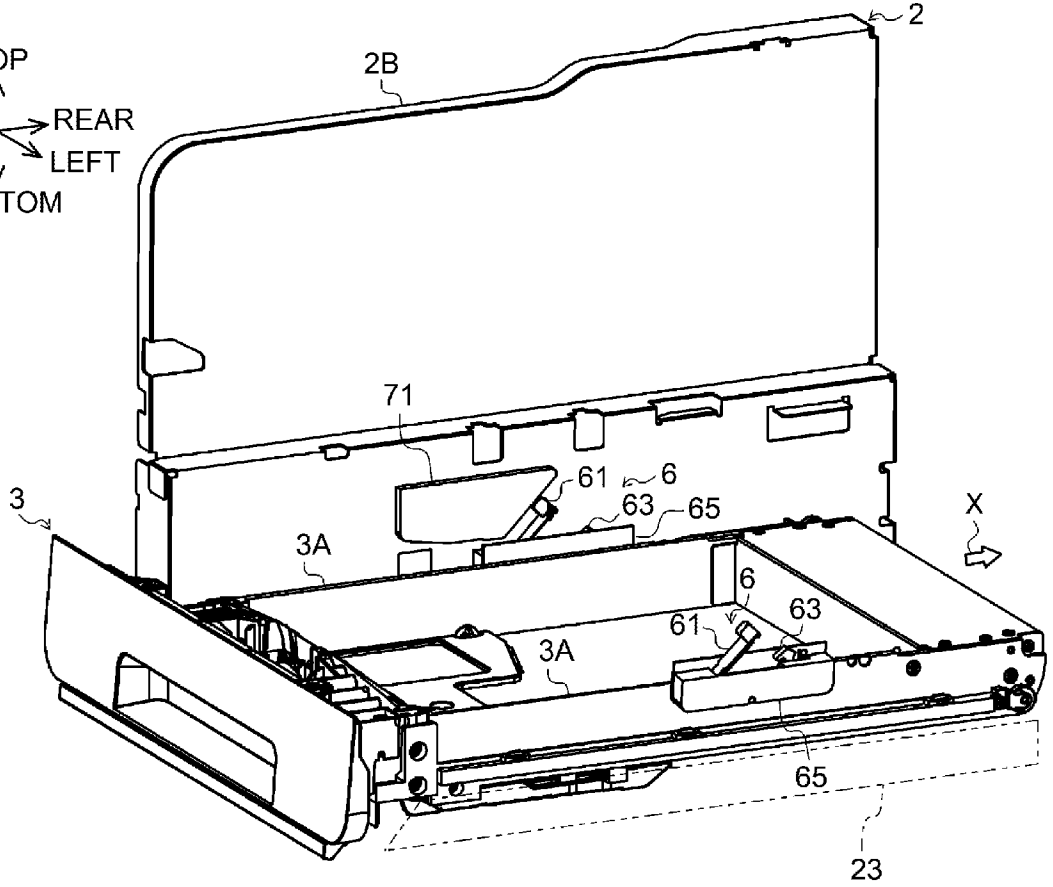
FIG. 3 is a perspective view of a portion of a side surface of a casing and a sheet supply tray.

In the illustrative embodiment, the casing 2 and the sheet supply tray 3 include a guide, e.g., a guide member group 7, and a retract assembly 6, respectively, as depicted in FIG. 3.

With the retract assembly 6 and the guide member group 7, ease of operation may increase when the sheet supply tray 3 is moved in the inserting direction, e.g., a direction from the pulled position in which the sheet supply tray 3 is pulled out from the casing 2 toward the installed position in which the sheet supply tray 3 is installed in the casing 2.

Next, structures of the casing 2 will be described.

As depicted in FIG. 2, the casing 2 is provided at its interior with a feeder unit 4 configured to supply recording sheets S one by one from the sheet supply tray 3, and an image forming unit 5 configured to form an image on a supplied recording sheet S.

The feeder unit 4 includes a separation pad 42 and a paper dust removal roller 44 that are disposed at the sheet supply tray 3, and a separation roller 41, a pickup roller 43 and an opposing roller 45 that are disposed in the casing 2.

When the lift plate 31 of the sheet supply tray 3 is in the supply position, recording sheets S on the lift plate 31 are pressed by the pickup roller 43. The recording sheets S are started to be fed by the rotation of the pickup roller 43 toward a separation position between the separation roller 41 and the separation pad 42.

The recording sheets S fed by the pickup roller 43 toward the separation position are separated one by one when the recording sheets S are held between the separation roller 41 and the separation pad 42 by the rotation of the separation roller 41.

A separated recording sheet S is fed upward though a portion between the separation roller 41 and the separation pad 42. While the recording sheet S is passing between the paper dust removal roller 44 and the opposing roller 45, paper dust is removed. Thereafter, the recording sheet S is fed to a pair of registration rollers 46 disposed in the casing 2. The registration rollers 46 are disposed downstream of the paper dust removal roller 44 and the opposing roller 45 in a feeding direction of a recording sheet S.

The registration rollers 46 correct skew of the recording sheet S fed to the registration rollers 46. Thereafter, the recording sheet S is fed to respective transfer positions between photosensitive drums 52A and corresponding transfer rollers 52C. At a transfer position, a toner image on a photosensitive drum 52A is transferred to the recording sheet S.

The image forming unit 5 includes a scanner unit 51, process cartridges 52, and a fixing unit 53.

The scanner unit 51 includes a laser light source, polygon mirrors and lenses that are not depicted. The scanner unit 51 is disposed at an upper portion of the casing 2. The scanner unit 51 is configured to scan across surfaces of the photosensitive drums 52A (described below) at high speed by irradiating the surfaces with laser light (e.g., refer to arrows A in FIG. 2) emitted from the laser light source, based on input image data, while the laser light is reflected off the polygon mirrors and passed through the lenses.

The process cartridges 52 are configured to transfer developer images, e.g., toner images, onto a recording sheet S.

Each of the process cartridges 52 includes an image carrier, e.g., the photosensitive drum 52A, a charger 52B, a transfer roller 52C, a developing roller 52D, a toner chamber 52E, and a layer thickness regulating blade 52F.

Surfaces of the respective photosensitive drums 52A are uniformly charged by the respective charger 52B. Thereafter, the surfaces of the photosensitive drums 52A are exposed to the laser light emitted from the scanner unit 51, so that electrostatic latent images based on image data are formed on the surfaces of the respective photosensitive drums 52A. Thereafter, the toner in the respective toner chambers 52E is supplied by the respective developing rollers 52D to the corresponding photosensitive drums 52A. Thus, the electrostatic latent images are made visible, and toner images are formed on the respective photosensitive drums 52A.

In such a state, as a recording sheet S supplied by the feeder unit 4 passes between the photosensitive drums 52A and the transfer rollers 52C, the toner images on the respective photosensitive drums 52A are transferred onto the recording sheet S.

In the illustrative embodiment, a plurality of, e.g., four, process cartridges 52 are provided for various color arrangements of toner images. The process cartridges 52 are arranged in line along the feeding direction of recording sheets S (e.g., the front-rear direction).

The fixing unit 53 is disposed behind the process cartridges 52. The fixing unit 53 includes a fixing frame 53A, and a heat roller 53B and a pressure roller 53C supported by the fixing frame 53A.

The heat roller 53B includes a metal tube whose surface is coated with fluorine resin, and a halogen lamp disposed inside the metal tube and configured to apply heat. The heat roller 53B is configured to be driven or rotated by a drive force from a motor (not depicted).

The pressure roller 53C is disposed facing the heat roller 53B and pressed against the heat roller 53B. The pressure roller 53C is disposed at least partially below the heat roller 53B. The pressure roller 53C includes a metal roller shaft that is covered by a roller portion including rubber material. The pressure roller 53C is configured to rotate following the rotation of the heat roller 53B.

In the fixing unit 53 as described above, toner transferred onto a recording sheet S at the respective transfer positions is thermally fixed as the recording sheet S passes between the heat roller 53B and the pressure roller 53C. Thus, an image is formed on the recording sheet S. The recording sheet S having an image formed thereon is fed toward a discharge path 9 extending in the top-bottom direction toward an upper surface of the casing 2.

Thereafter, the recording sheet S fed to the discharge path 9 is discharged onto a discharge tray 21 disposed at an upper surface of the casing 2, by a plurality of discharge rollers 8 disposed at an upper portion of the discharge path 9 (e.g., a downstream side of the discharge path 9 in the feeding direction).

[Structures of Retract Assembly 6 and Guide Member Groups 7]

Next, structures of the retract assemblies 6 and the guide member groups 7 will be described referring to FIGS. 3-7.

The retract assemblies 6 and the guide member groups 7 are configured to provide assistance to the sheet supply tray 3 when the sheet supply tray 3 is moved or retracted relative to the casing 2 in the inserting direction.

Each of the retract assemblies 6 is disposed at a substantially central portion of a corresponding one of left and right side surface 3A of the sheet supply tray 3 in the front-rear direction, for example, as depicted in FIG. 3. Each of the guide member groups 7 is disposed facing a corresponding retract assembly 6 when the sheet supply tray 3 is in the installed position. Each of the guide member groups 7 is disposed at a lower portion of a corresponding one of left and right inner wall plates 2B of the casing 2 (only the right guide member group 7 is depicted in FIG. 3).

The arrangement/configuration of the retract assemblies 6 and the guide member groups 7 is not limited to that which is described in the illustrative embodiment. For example, the retract assemblies 6 may be disposed at the inner wall plates 2B of the casing 2, and the guide member groups 7 may be disposed at the side surfaces 3A of the sheet supply tray 3.

However, it is preferable to provide the guide member groups 7 at the inner wall plates 2B of the casing 2 and provide the retract assemblies 6 at the side surfaces 3A of the sheet supply tray 3, as in the illustrative embodiment. As the movable retract assemblies 6 are disposed at the removable sheet supply tray 3, the retract assemblies 6 may be readily returned to a normal state, for example, even if an unintentional or unexpected retracting operation failure should occur.

Structures of the retract assemblies 6 will be described in detail.

The retract assemblies 6 disposed at the right and left side surfaces 3A of the sheet supply tray 3 are symmetrical with each other and have similar or the same structures. Therefore, in the following description, the right retract assembly 6 will be described in detail and detailed description of the left retract assembly 6 will be omitted herein.

Figure 4:
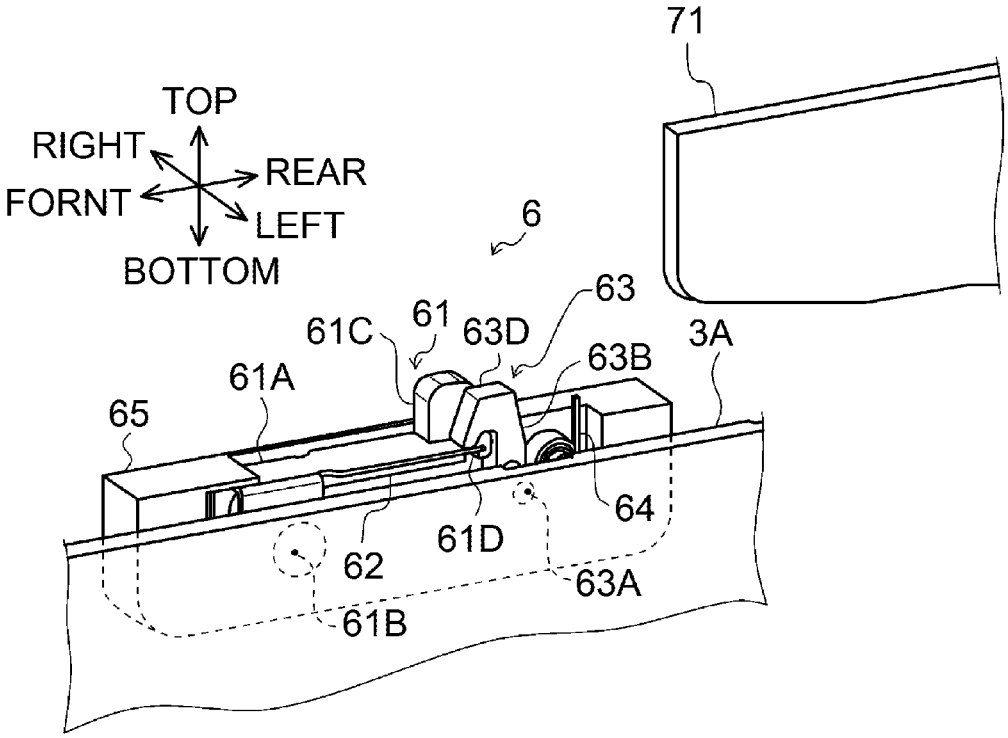
FIG. 4 is a perspective view of a retract assembly and a periphery thereof when a pushing assembly is in a retracted position and a second arm is in a regulating position.

As depicted in FIG. 4, the retract assembly 6 mainly includes a pushing assembly 61, a first spring 62 configured to bias the pushing assembly 61, a second arm 63, a second spring 64 configured to bias the second arm 63, and a frame 65 that supports the members 61-64.

Figure 6A:
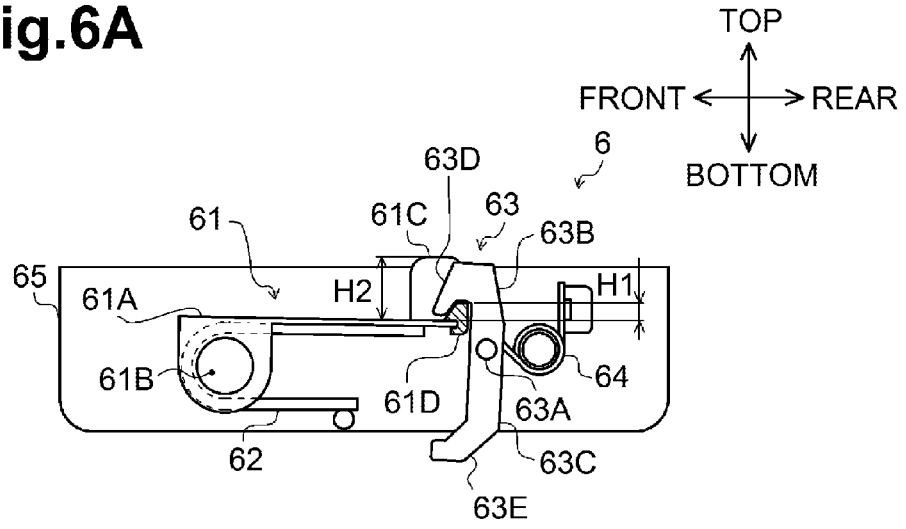
FIG. 6A is a sectional side view of the retract assembly when the pushing assembly is in the retracted position and the second arm is in the regulating position.
Figure 6B:
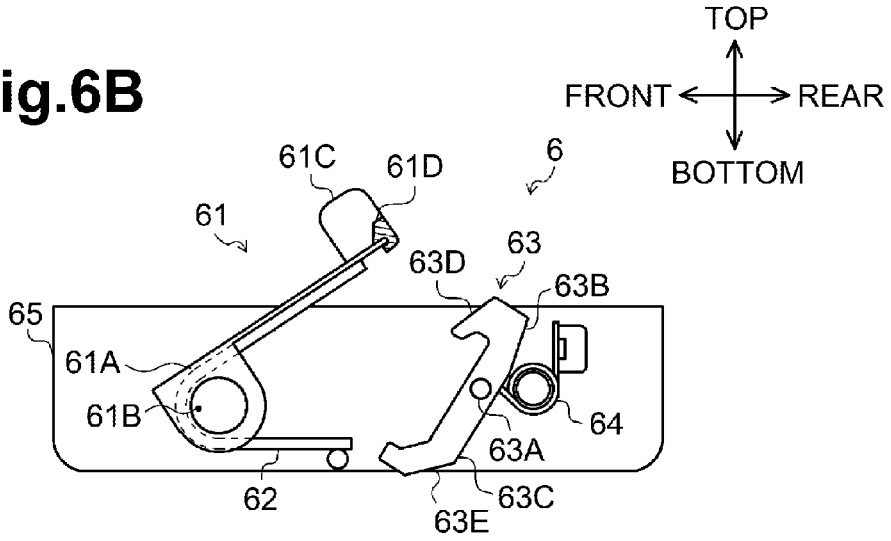
FIG. 6B is a sectional side view of the retract assembly when the pushing assembly is in the protruding position and the second arm is in the release position.

As depicted in FIG. 6A, the pushing assembly 61 includes an first arm 61A extending in the front-rear direction, a first pivot axis, e.g., a first pivot shaft 61B disposed at a front end portion of the first arm 61A, a first protrusion 61C disposed at a rear end portion of the first arm 61A, and a second protrusion 61D disposed adjacent to the first protrusion 61C at a rear end portion of the first arm 61A.

The first pivot shaft 61B extends in the left-right direction (e.g., a perpendicular direction or an axial direction), which is perpendicular to the inserting direction of the sheet supply tray 3. The first pivot shaft 61B pivotally supports the first arm 61A to allow the first arm 61A to move between a retracted position (refer to FIG. 6A) and a protruding position (refer to FIG. 6B). In the retracted position, the first arm 61A is disposed extending horizontally in the front-rear direction, e.g., the inserting direction. In the protruding position, the rear end of the first arm 61A (e.g., the downstream end in the inserting direction) is disposed higher, in a protruding direction perpendicular to both of the inserting direction and an axial direction of the first pivot shaft 61B.

The positional relationship of components of the retract assembly 6 will be described with reference to a position of the first arm 61A of the pushing assembly 61 in the retracted position.

As depicted in FIG. 6A, the first protrusion 61C is disposed at a rear end portion of the first arm 61A opposite to the first pivot shaft 61B in the inserting direction. The first protrusion 61C protrudes upward in the protruding direction. The first protrusion 61C is disposed such that an upper end thereof is positioned higher than an upper end of the frame 65 in the protruding direction. The first protrusion 61C may include resin.

The second protrusion 61D is disposed at a rear end portion of the first arm 61A opposite to the first pivot shaft 61B in the inserting direction. A portion of the second protrusion 61D protrudes upward in the protruding direction relative to the first arm 61A. A protruding amount of the second protrusion 61D (e.g., a dimension H1 in FIG. 6A) is smaller than a protruding amount of the first protrusion 61C (e.g., a dimension H2 in FIG. 6A).

Figure 7:
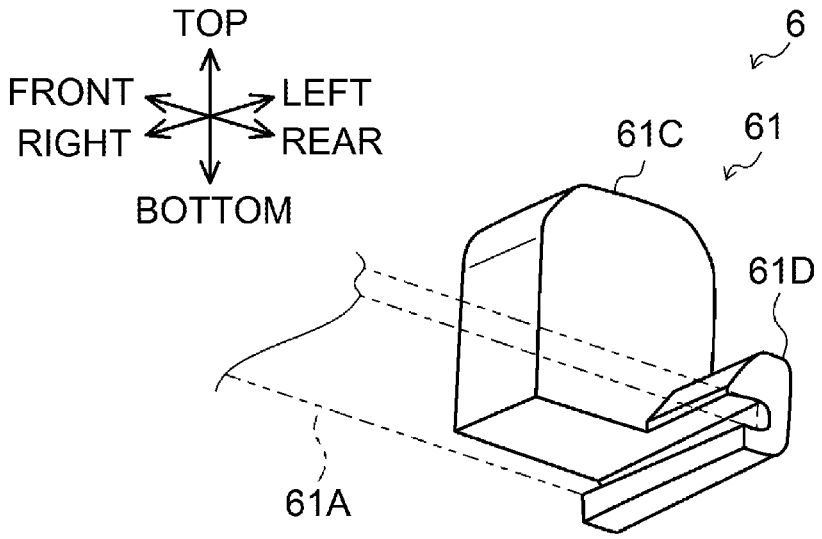
FIG. 7 is an enlarged perspective view of a first protrusion and a second protrusion of the pushing assembly.

The second protrusion 61D may also include resin. For example, as depicted in FIG. 7, the first protrusion 61C and the second protrusion 61D are integrally formed and attached to the first arm 61A in the illustrative embodiment. As the first protrusion 61C and the second protrusion 61D are integrally formed, the number of components of the pushing assembly 61 may be reduced, leading to cost reduction.

Structures of the first protrusion 61C and the second protrusion 61D are not limited to those described in the illustrative embodiment. For example, the first protrusion 61C and the second protrusion 61D may be separately provided.

The first spring 62 is configured to bias the pushing assembly 61 toward the protruding position. In the illustrative embodiment, the first spring 62 includes, for example, a plate spring bent into a U-shape.

The second arm 63 is configured to hold the pushing assembly 61 temporarily in the retracted position while regulating the movement of the pushing assembly 61 from the retracted position to the protruding position. As depicted in FIG. 6A, the second arm 63 extends in the top-bottom direction and is disposed behind the pushing assembly 61 such that an upper end portion of the second arm 63 is disposed adjacent to the second protrusion 61D.

The second arm 63 includes a second pivot shaft 63A, a regulating arm 63B, and a contact arm 63C.

The second pivot shaft 63A extends in the left-right direction, which is the same direction as an axial direction of the first pivot shaft 61A. The second pivot shaft 63A pivotally supports the second arm 63. The second pivot shaft 63A is disposed at a substantially central portion of the second arm 63 in the top-bottom direction and below the second protrusion 61D of the pushing assembly 61.

The regulating arm 63B extends upward from the second pivot shaft 63A.

A hook portion 63D is formed at the regulating arm 63B and protrudes downward and frontward, e.g., toward an upstream side in the inserting direction, e.g., in a shape of a hook.

The contact arm 63C extends from the second pivot shaft 63A in a downward direction opposite to a direction in which the regulating arm 63B extends. An inclined surface 63E is formed at the contact arm 63C. The inclined surface 63E is inclined to face downward and rearward, e.g., downstream in the inserting direction.

The second arm 63 is configured to move between a regulating position and a release position as the second arm 63 pivots about the second pivot shaft 63A. In the regulating position, the second arm 63 engages the second protrusion 61D of the pushing assembly 61 situated in the retracted position via the hook portion 63D and a portion of the contact arm 63C protrudes downward through the frame 65. In the release position, the second arm 63 is pivotally moved rearward from the regulating position such that the hook portion 63D is separated from the second protrusion 61D and the contact arm 63C is moved forward from the regulating position.

The regulating arm 63B of the second arm 63 is disposed at a position not overlapping with the first protrusion 61C in the left-right direction, e.g., the axial direction of the first pivot shaft 61B, when viewed in the inserting direction.

When the regulating arm 63B engages the second protrusion 61D, an upper end of the regulating arm 63B is disposed below an upper end of the first protrusion 61C. For example, a protruding amount of the regulating arm 63B relative to the first arm 61A in the protruding direction is smaller than a protruding amount of the first protrusion 61C relative to the first arm 61A in the protruding direction.

The second spring 64 is configured to bias the second arm 63 toward the regulating position. The second spring 64 is, for example, a torsion coil spring, in the illustrative embodiment. In other words, the hook portion 63D of the second arm 63 is constantly biased by the second spring 64 toward the regulating position in which the hook portion 63D engages the second protrusion 61D.

In the illustrative embodiment, a biasing force of the second spring 64 is set smaller than a biasing force of the first spring 62.

Next, structures of the guide member groups 7 will be described in detail.

The guide member groups 7 disposed at the right and left inner wall plates 2B of the casing 2 are symmetric with each other, and have similar or the same structures. Therefore, the right guide member group 7 will be mainly described hereinafter, and detailed description of the left guide member group 7 is omitted herein.

Figures 8A, 8B:
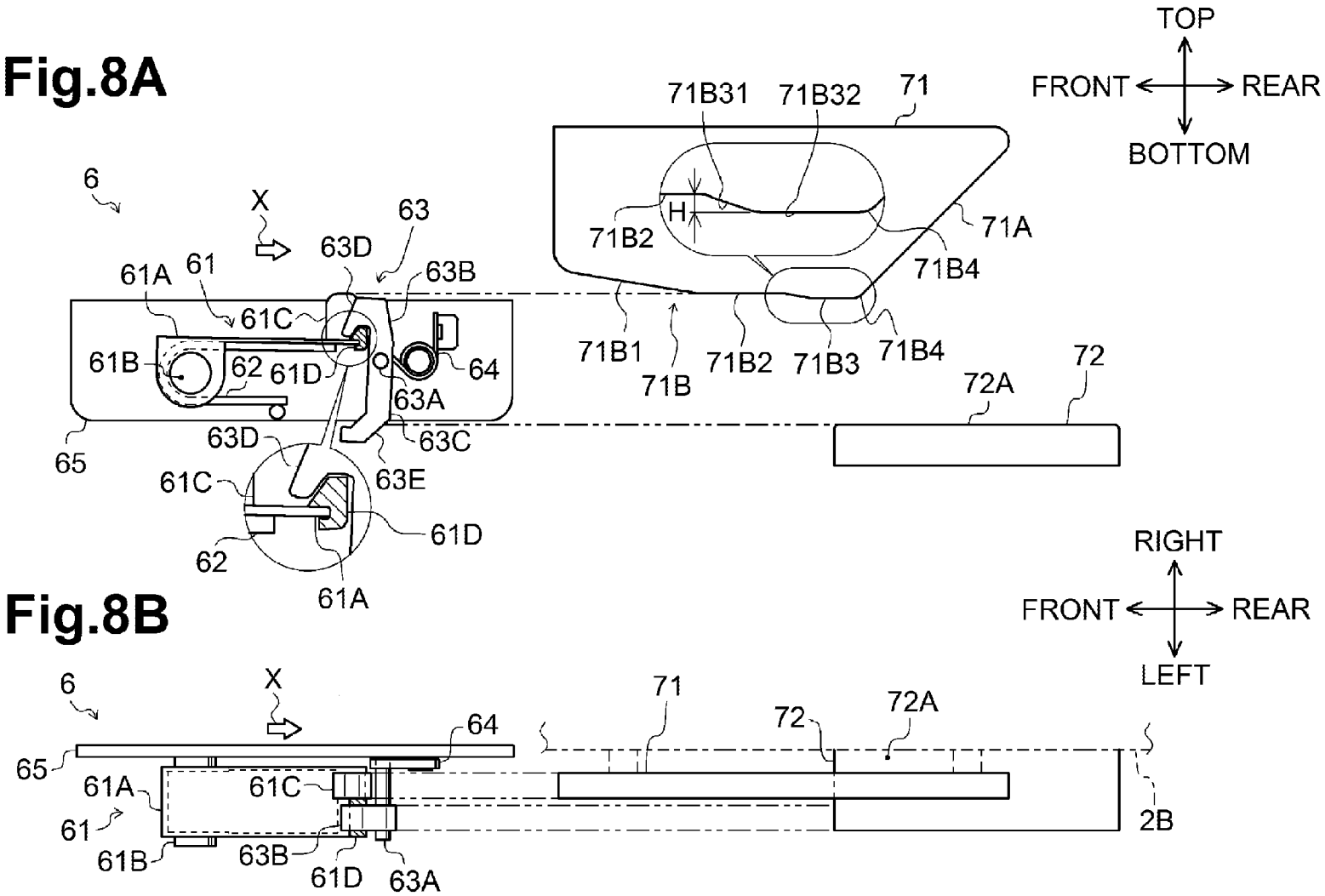
FIG. 8A is a side view of the retract assembly and a guide mechanism, illustrating a positional relationship therebetween.
FIG. 8B is a top plan view of the retract assembly and the guide mechanism, illustrating a positional relationship therebetween.

The guide member group 7 includes a wall, e.g., an inclined guide 71, and a protruding guide 72, as depicted in FIG. 8A.

The inclined guide 71 includes a plate member. The inclined guide 71 has a substantially same dimension in the left-right direction as that of the first protrusion 61C in the left-right direction. The inclined guide 71 is disposed above the corresponding retract assembly 6 when the sheet supply tray 3 is situated in the installed position.

As depicted in FIG. 8B, the inclined guide 71 is disposed at the inner wall plate 2B of the casing 2. The inclined guide 71 is disposed at the same position as the first protrusion 61C in the left-right direction, e.g., the axial direction of the first pivot shaft 61B, in top plan view. For example, when viewed in the inserting direction, the inclined guide 71 and the first protrusion 61C may overlap one another. The first protrusion 61C is configured to contact a portion of the inclined guide 71 when the sheet supply tray 3 is guided along the rail 23 in the inserting direction.

Further, the inclined guide 71 and the second arm 63 are disposed at positions not overlapping with each other in the left-right direction, e.g., the axial direction of the first pivot shaft 61B when viewed in the inserting direction.

The inclined guide 71 includes an inclined surface 71A and an extending surface 71B.

As depicted in FIG. 8A, the inclined surface 71A is provided at a rear end portion of the inclined guide 71. The inclined surface 71A is inclined relative to the inserting direction obliquely in an upward direction from an upstream side to a downstream side, and faces rearward (e.g., a downstream side in the inserting direction) and downward.

The extending surface 71B is provided at a lower end portion of the inclined guide 71. The extending surface 71B extends upstream in the inserting direction from an upstream end portion (e.g., a front end portion) of the inclined surface 71A in the inserting direction.

The extending surface 71B includes a first extending surface 71B1, a second extending surface 71B2, a third extending surface 71B3, and a curved surface 71B4, that are disposed in this order in the inserting direction (e.g., toward the rear side).

The curved surface 71B4 extends upstream in the inserting direction (e.g., frontward) from an upstream end portion of the inclined surface 71A in the inserting direction (e.g., a front end portion). The curved surface 71B4 is curved convex downward. More specifically, the curved surface 71B4, e.g., a surface that faces the first protrusion 61C when the sheet supply tray 3 is guided by the rail 23, is convexly curved toward the first protrusion 61C.

The third extending surface 71B3 extends upstream in the inserting direction (e.g., frontward) from an upstream end portion of the curved surface 71B4 in the inserting direction (e.g., a front end portion).

The third extending surface 72B3 includes a horizontal surface 71B32 and an inclined surface 71B31. The horizontal surface 71B32 extends upstream in the inserting direction (e.g., frontward) and substantially horizontally from the curved surface 71B4. The inclined surface 71B31 extends upstream in the inserting direction (e.g., frontward) in a slightly obliquely upward direction from an upstream end portion of the horizontal surface 71B32 in the inserting direction.

The second extending surface 71B2 extends upstream in the inserting direction (e.g., frontward) and substantially horizontally from an upstream end portion of the inclined surface 71B31 in the inserting direction.

The first extending surface 71B1 extends upstream in the inserting direction (e.g., frontward) and obliquely upward from an upstream end portion of the second extending surface 71B2 in the inserting direction.

The protruding guide 72 includes a rectangular plate member. The protruding guide 72 is disposed on the inner wall plate 2B of the casing 2 at a position below the inclined guide 71. The protruding guide 72 protrudes from the inner wall plate 2B in the left-right direction perpendicular to the inserting direction, e.g., the axial direction of the first pivot shaft 61B, toward the corresponding retract assembly 6 when the sheet supply tray 3 is in the installed position, and extends in the inserting direction.

An upper surface 72A of the protruding guide 72 extends in the inserting direction and substantially horizontally. The upper surface 72A is disposed slightly below the lower end of the frame 65 when the sheet supply tray 3 is guided along the rail 23.

[Procedures for Installing Sheet Supply Tray 3]

Next, procedures for installing the sheet supply tray 3 in casing 2 of the laser printer 1 according to the illustrative embodiment will be described referring to FIGS. 8-11

Figure 9A:
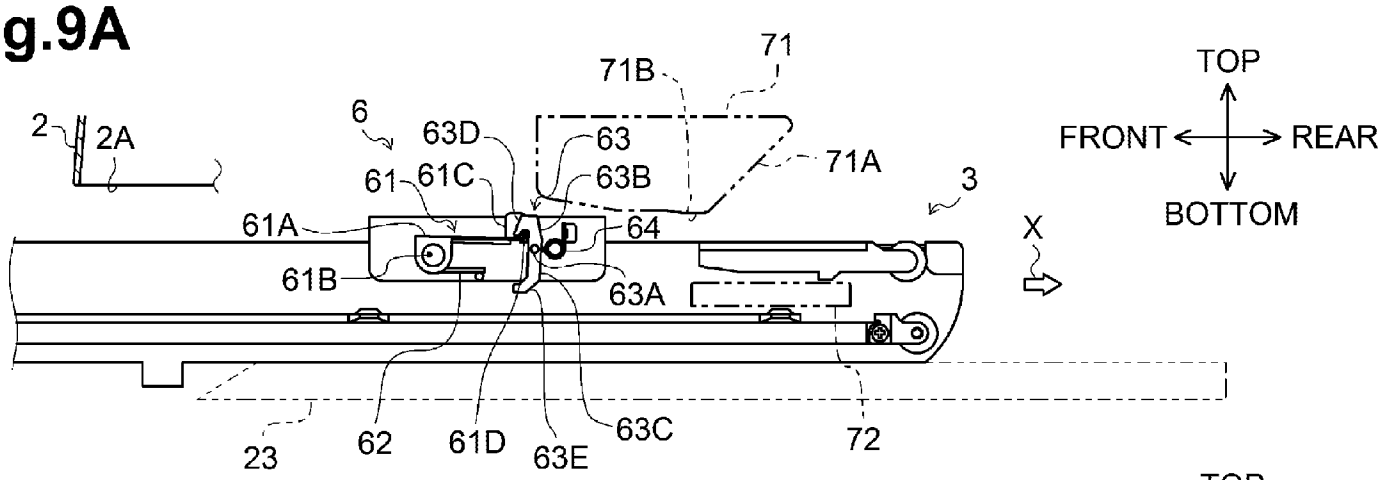
FIG. 9A is a side view of the sheet supply tray that moves in an inserting direction, illustrating a state of the sheet supply tray before the retract assembly reaches the guide mechanism.

When the sheet supply tray 3 is in the pulled position in which a portion of the sheet supply tray 3 is pulled out from the casing 2, as depicted in FIG. 9A, the pushing assembly 61 of the retract assembly 6 is in the retracted position and the second arm 63 of the retract assembly 6 is in the regulating position. In other words, in the retract assembly 6, the second protrusion 61D of the pushing assembly 61 and the hook portion 63D of the second arm 63 engage with each other.

In the illustrative embodiment, the rail 23 provided in the casing 2 is configured to guide the movement of the sheet supply tray 3 and is separately provided from the guide mechanism, e.g., the guide member groups 7.

Figure 10A:
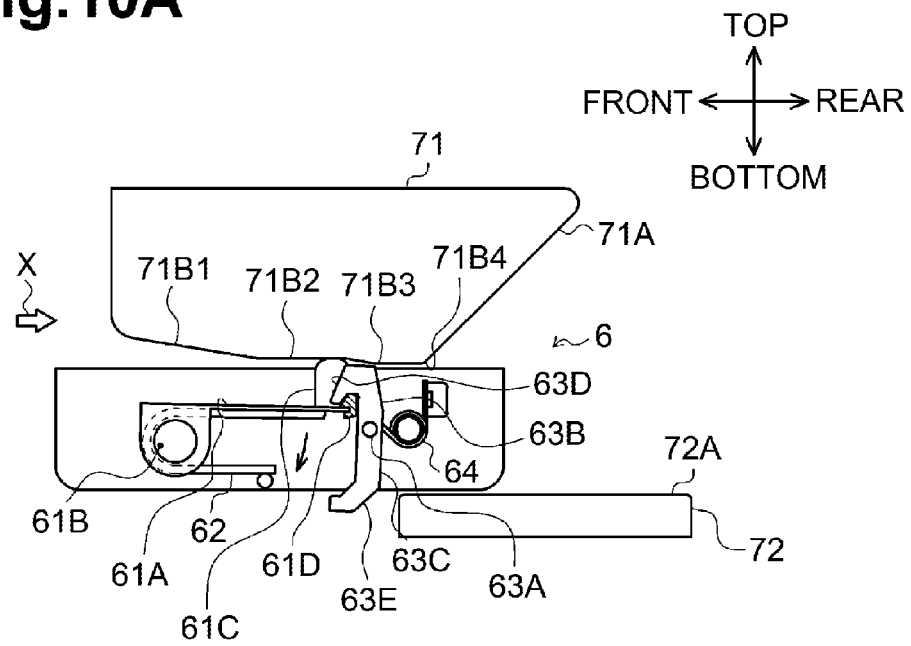
FIG. 10A is a side view of the retract assembly and the guide mechanism, illustrating a positional relationship therebetween in which the pushing assembly of the retract assembly contacts a second extending surface of an inclined guide.

As the sheet supply tray 3 is pushed downstream in the inserting direction from the pulled position, the first protrusion 61C of the pushing assembly 61 of the retract assembly 6 passes under the first extending surface 71B1 and the second extending surface 72B2 of the extending surface 71B of the inclined guide 71 and reaches an upstream end portion (e.g., a front end portion) of the third extending surface 71B3 in the inserting direction, as depicted in FIG. 10A.

A small space is provided in the top-bottom direction between an upper end surface of the first protrusion 61C of the pushing assembly 61 disposed at the retracted position, and a downstream end portion of the first extending surface 71B1 in the inserting direction (e.g., a rear end portion) and the second extending surface 71B2 extending substantially horizontally, when the sheet supply tray 3 is guided along the rail 23.

Figure 10B:
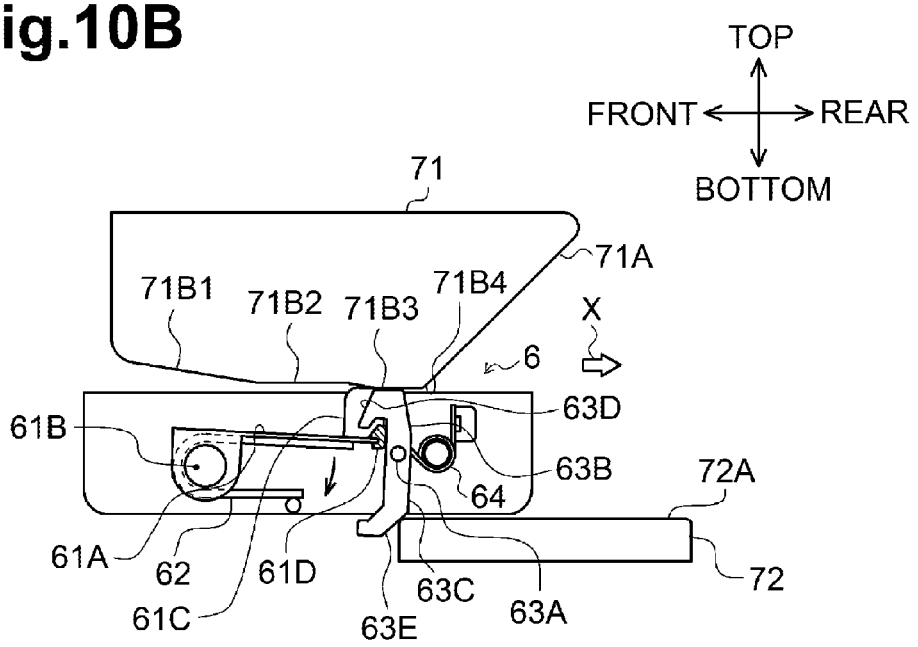
FIG. 10B is a side view of the retract assembly and the guide mechanism, illustrating a change in a positional relationship therebetween.

As the sheet supply tray 3 is further moved downstream in the inserting direction (e.g., rearward), the first protrusion 61C moves downstream in the inserting direction (e.g., rearward) while being slightly pressed down by the third extending surface 71B3, as depicted in FIG. 10B. At this time, the first protrusion 61C is biased upward by the first spring 62 toward the protruding position and, at the same time, regulated by the third extending surface 71B3.

In the illustrative embodiment, when the pushing assembly 61 is in the retracted position and the second arm 63 is in the regulating position, the first protrusion 61C of the pushing assembly 61 protrudes further than an upper end portion of the second arm 63 in the protruding direction perpendicular to the inserting direction and the axial direction of the first pivot shaft 61B. In one example, the first protrusion 61C protrudes upward, e.g., toward the inclined guide 71 (more specifically, toward the extending surface 71B or the inclined surface 71A).

Therefore, for example, as the pushing assembly 61 starts to contact the inclined guide 71 while the sheet supply tray 3 is moved downstream in the inserting direction (e.g., rearward), the second arm 63 is spaced from the inclined guide 71. Therefore, for example, troubles or problems caused by unintentional interference between the second arm 63 and the inclined guide 71 may be prevented or reduced.

In the illustrative embodiment, the inclined guide 71 and the second arm 63 do not overlap with each other in the axial direction of the first pivot shaft 61B. Therefore, for example, troubles or problems caused by unintentional interference between the second arm 63 and the inclined guide 71 may be prevented or reduced.

The first protrusion 61C pressed down by the third extending surface 71B3 is then moved downstream in the inserting direction (e.g., rearward) while contacting the third extending surface 71B3. As the first protrusion 61C includes resin, resistance and noises when the first protrusion 61C moves while contacting the third extending surface 71B may be reduced.

As the first protrusion 61C passes through the inclined surface 71B31 (refer to FIG. 8A) of the third extending surface 71B3, and reaches a front end portion of the horizontal surface 71B32, the inclined surface 63E of the second arm 63 contacts an upstream end portion (e.g., a front end portion) of the protruding guide 72 in the inserting direction.

Figure 11A:
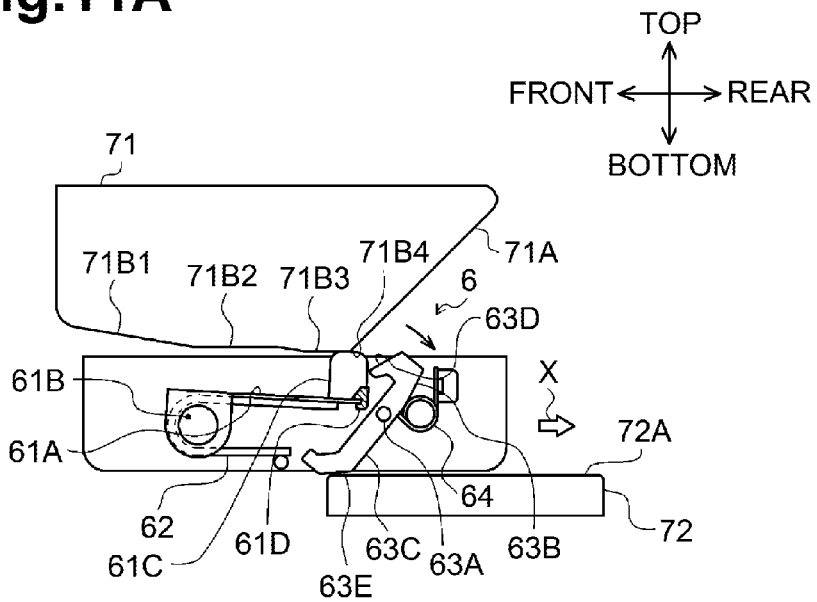
FIG. 11A is a side view of the retract assembly and the guide mechanism, illustrating another change in a positional relationship therebetween.

As the sheet supply tray 3 is moved downstream in the inserting direction (e.g., rearward), the protruding guide 72 pushes the inclined surface 63E upstream in the inserting direction, such that the second arm 63 pivotally moves in the counterclockwise direction in FIG. 11A.

As the sheet supply tray 3 is further moved downstream in the inserting direction (e.g., rearward), the inclined surface 63E comes up onto an upper surface 72A of the protruding guide 72. Accordingly, the second arm 63 pivotally moves to the release position about the second pivot shaft 63A against a biasing force of the second spring 64. As the inclined surface 63E is on the upper surface 72A of the protruding guide 72, the second arm 63 is maintained at the release position.

As the second arm 63 pivotally moves from the regulating position to the release position, the hook portion 63D of the second arm 63 separates from the second protrusion 61D of the pushing assembly 61, and the pushing assembly 61 and the second arm 63 are disengaged from each other.

With such structures, as the contact arm 63C is moved by the protruding guide 72, the hook portion 63D of the regulating arm 63B disposed opposite to the contact arm 63C across the second pivot shaft 63A disengages from the second protrusion 61D of the pushing assembly 61 in the illustrative embodiment.

In the illustrative embodiment, an upstream end portion (e.g., a front end portion) of the protruding guide 72 in the inserting direction is disposed more downstream in the inserting direction (e.g., more rearward) than an upstream end portion (e.g., a front end portion) of the third extending surface 71B3 of the inclined guide 71.

The third extending surface 71B3 of the inclined guide 71 is configured to contact the first protrusion 61C of the pushing assembly 61 before the protruding guide 72 contacts the inclined surface 63E of the second arm 63, when the sheet supply tray 3 is moved downstream in the inserting direction (e.g., rearward).

With such structures, in the illustrative embodiment, the third extending surface 71B3 presses the first protrusion 61C, so that the first arm 61A, the first protrusion 61C, and the second protrusion 61D are pressed down. For example, the second protrusion 61D moves downward and away from the hook portion 63D of the second arm 63.

After the second protrusion 61D moves away from the hook portion 63D, the second arm 63 is pivotally moved by the protruding guide 72 in a clockwise direction in FIG. 11A so that the second protrusion 61D and the hook portion 63D are separated from each other. Therefore, before the second arm 63 moves from the regulating position to the release position, the second protrusion 61D and the hook portion 63D are disengaged. Therefore, a load required for an operation of releasing the regulation of the pushing assembly 61 by the second arm 63 may be reduced, and the releasing operation may be stably performed.

As described above, the second protrusion 61D includes resin in the illustrative embodiment. Accordingly, a frictional force generated when the hook portion 63D of the second arm 63 engages with or disengage from the second protrusion 61D, or the second protrusion 61D may be reduced, so that durability of the protruding portion 61D and the hook portion 63D may increase.

As depicted in FIG. 8A, a dimensional difference between the second extending surface 71B2 and the third extending surface 71B3 in the top-bottom direction (e.g., a dimension H in FIG. 8A) is set slightly greater than the protruding amount of the second protrusion 61D of the pushing assembly 61 (e.g., the dimension H1 in FIG. 6A).

With such setting, a movement distance that the second protrusion 61D moves (corresponding to the dimension H) as the first protrusion 61C is pressed down by the third extending surface 71B3 is greater than the protruding amount of the second protrusion 61D (e.g., the dimension H1). Accordingly, after the second protrusion 61D moves down away from the hook portion 63D, the second arm 63 pivotally moves in a clockwise direction in FIG. 11A. Therefore, a releasing operation by the second arm 63 may be stably performed.

As the sheet supply tray 3 further moves downstream in the inserting direction (e.g., rearward) after the pushing assembly 61 and the second arm 63 are disengaged, the first protrusion 61C of the pushing assembly 61 reaches an upstream end portion (e.g., a front end portion) of the inclined surface 71A of the inclined guide 71 in the inserting direction.

Thereafter, the first protrusion 61C which is released from regulation of the extending surface 71B of the inclined guide 71 (e.g., the third extending surface 71B3) pivotally moves about the first pivot shaft 61B to the protruding position by a biasing force of the first spring 62. For example, the first arm 61A and the first protrusion 61C of the pushing assembly 61 is biased by the first spring 62 toward the protruding position.

Figure 5:
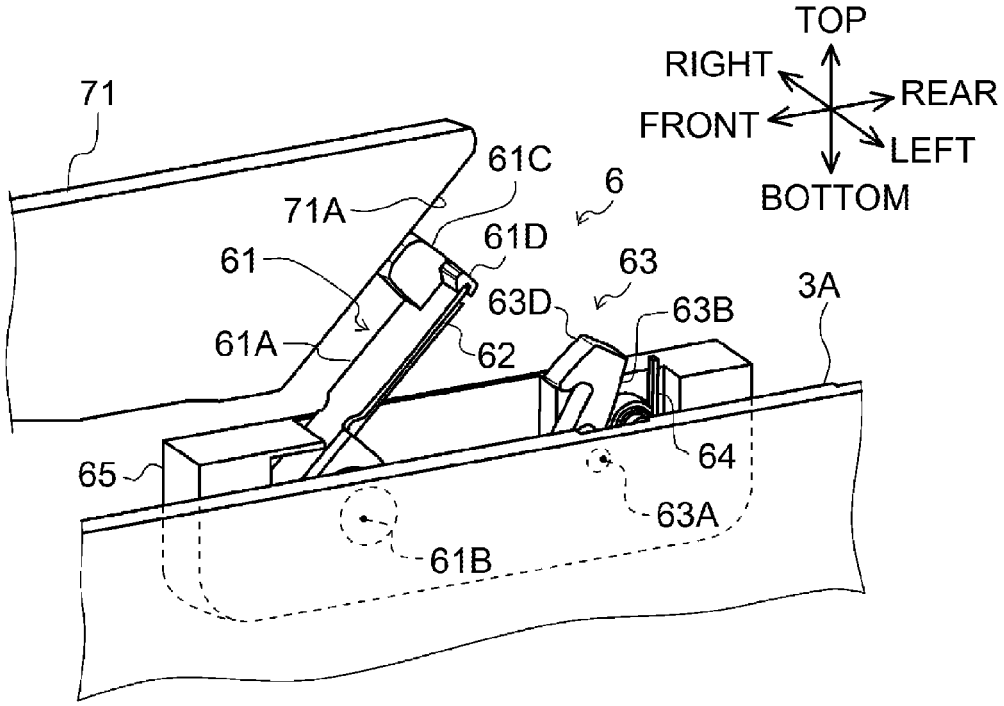
FIG. 5 is a perspective view of the retract assembly and a periphery thereof when the pushing assembly is in a protruding position and the second arm is in a release position.

In the illustrative embodiment, the first protrusion 61C is pivotally moved counterclockwise in FIG. 5 about the first pivot shaft 61B by a biasing force of the first spring 62, to press the inclined surface 71A of the inclined guide 71.

Consequently, the sheet supply tray 3 including the retract assembly 6 is moved downstream in the inserting direction (e.g., rearward) by a force of the first protrusion 61C pressing the inclined surface 71A with a biasing force of the first spring 62. At this time, the first protrusion 61C presses the inclined surface 71A while moving downstream in the inserting direction (e.g., rearward), and moves to the protruding position.

Figure 11B:
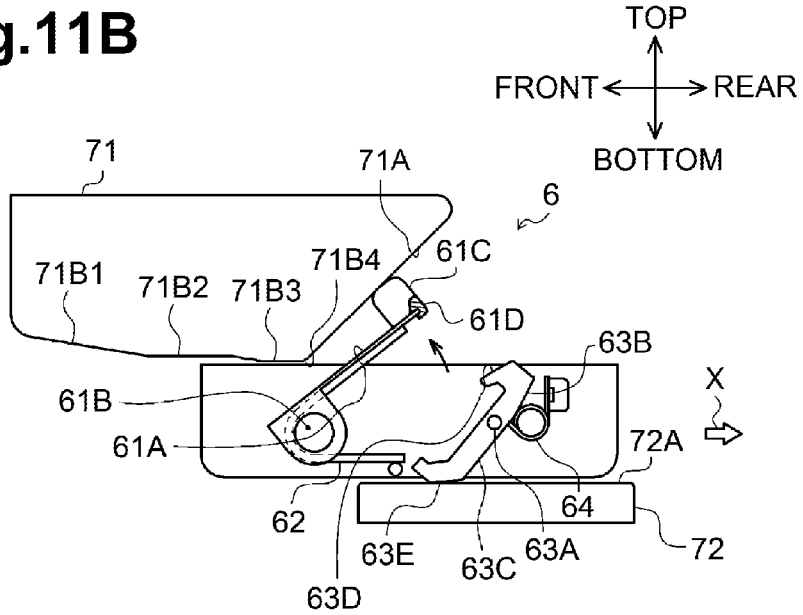
FIG. 11B is a side view of the retract assembly and the guide mechanism, illustrating yet another change in a positional relationship therebetween.

As depicted in FIG. 11B, when the pushing assembly 61 moves to the protruding position, the sheet supply tray 3 is disposed in the installed position in which the sheet supply tray 3 is installed in the casing 2. At this time, the inclined surface 63E of the second arm 63 contacts the upper surface 72A of the protruding guide 72. For example, the protruding guide 72 and the second arm 63 are constantly engaged with each other when the sheet supply tray 3 is moving toward the installed position after the first protrusion 61C contacts the third extending surface 71B3 of the extending surface 71B, and when the sheet supply tray 3 is in the installed position.

As the first protrusion 61C is formed in the pushing assembly 61 as in the illustrative embodiment, for example, a movement amount of the pushing assembly 61 when pivoting from the retracted position to the protruding position may be set smaller by a protruding amount of the first protrusion 61C.

In the illustrative embodiment, the inclined guide 71 has a substantially same dimension as the first protrusion 61C in the left-right direction, as described above. The inclined guide 71 and the first protrusion 61C are aligned with each other in a linear fashion in top plan view. In other words, the second arm 63 is disposed at a position not overlapping with the inclined guide 71 in the axial direction of the axial direction of the first pivot shaft 61B.

With such structures, for example, when the second arm 63 is pivotally moved from the regulating position to the release position after the pushing assembly 61 starts to contact the inclined surface 71A while the sheet supply tray 3 is moved downstream in the inserting direction (e.g., rearward), troubles or problems caused by unintentional interference between the second arm 63 and the inclined surface 71A of the inclined guide 71 may be prevented or reduced.

As the first protrusion 61C of the pushing assembly 61 in the retract assembly 6 contacts the inclined surface 71A while pivoting about the first pivot shaft 61B, the sheet supply tray 3 is moved downstream in the inserting direction (e.g., rearward) relative to the casing 2 including the inclined guide 71. In other words, the inclined guide 71 applies force to the retract assembly 6 via the inclined surface 71A to move the retract assembly 6 downstream in the inserting direction (e.g., rearward). Thus, the sheet supply tray 3 is automatically retracted to the installed position.

In the illustrative embodiment, the curved surface 71B4 is formed between a downstream end portion of the third extending surface 71B3 in the inserting direction (e.g., a rear end portion) and an upstream end portion of the inclined surface 71A in the inserting direction (e.g., a front end portion), as described above. In the extending surface 71B, the first extending surface 71B1 is disposed upstream of the curved surface 71B4 in the inserting direction. The first extending surface 71B1 is inclined relative to the inserting direction to face downward and upstream in the inserting direction.

Frictional resistance generated between the pushing assembly 61 and extending surface 71B may be reduced or eliminated as much as possible until the pushing assembly 61 reaches the third extending surface 71B3. During installation of the sheet supply tray 3, an operation for pushing the sheet supply tray 3 to a predetermined position where the inclined surface 63E of the second arm 63 contacts the protruding guide 72, may be facilitated for users and ease of operation may increase.

A direction of force that the pushing assembly 61 receives from the third extending surface 71B3 when the sheet supply tray 3 is guided along the rail 23 is the top-bottom direction perpendicular to the inserting direction. Therefore, a load that the pushing assembly 61 receives from the third extending surface 71B3 when moving in the inserting direction (e.g., during installation of the sheet supply tray 3) may be smaller, and ease of an installation operation may increase.

As a biasing force of the second spring 64 is set smaller than a biasing force of the first spring 62, a biasing force when the pushing assembly 61 moves from the retracted position to the protruding position is increased or strengthened. Load required to release the regulation of the second arm 63 may be reduced. Accordingly, ease of the installation operation may increase.

In other words, when a biasing force of the second spring 64 is greater, resistance when the sheet supply tray 3 is guided along the rail 23 for installation becomes greater, and a burden or load on a user increases. However, in the illustrative embodiment, a biasing force of the second spring 64 is set smaller. Therefore, the sheet supply tray 3 may be retracted properly while burden on a user to install the sheet supply tray 3 is reduced.

Further, the first pivot shaft 61B of the pushing assembly 61 is disposed upstream of the first protrusion 61C in the inserting direction (e.g., on a front side). After the second arm 63 pivotally moves from the regulating position to the release position, the pushing assembly 61 moves counterclockwise in FIG. 11A toward the protruding position, so that the first protrusion 61C contacts the inclined surface 71A.

With such structures and arrangements, as the sheet supply tray 3 passes through the predetermined position in an operation to install the sheet supply tray 3 in the casing 2, the second arm 63 pivotally moves to the release position, so that the pushing assembly 61 contacts the inclined surface 71A of the inclined guide 71, and the sheet supply tray 3 is automatically retracted to the installed position.

Therefore, ease of operation for installing the sheet supply tray 3 may increase for users. When the first protrusion 61C pivotally moves from the retracted position to the protruding position toward the inclined surface 71A, the first protrusion 61C moves upstream in the inserting direction. Therefore, as compared with a structure in which a protruding portion of a pushing assembly is moved downstream in the inserting direction or perpendicularly to the inserting direction, a retracting amount of the sheet supply tray 3 may be ensured with a smaller pivot angle of the pushing assembly 61. Thus, the image forming apparatus may be reduced in size as a whole.

In the above-described illustrative embodiment, functions of the guide mechanism are not provided to the rail 23. Therefore, a releasing operation in the retract assemblies 6 may not be adversely effected by significant frictional resistance generated between the sheet supply tray 3 and the rail 23 and thus a retracting operation may be stabilized.

Next, procedures for pulling out the sheet supply tray 3 situated in the installed position in the casing 2 to the pulled position will be described.

The pulling-out procedure is performed in the reverse order of the installation procedure.

Figure 9B:
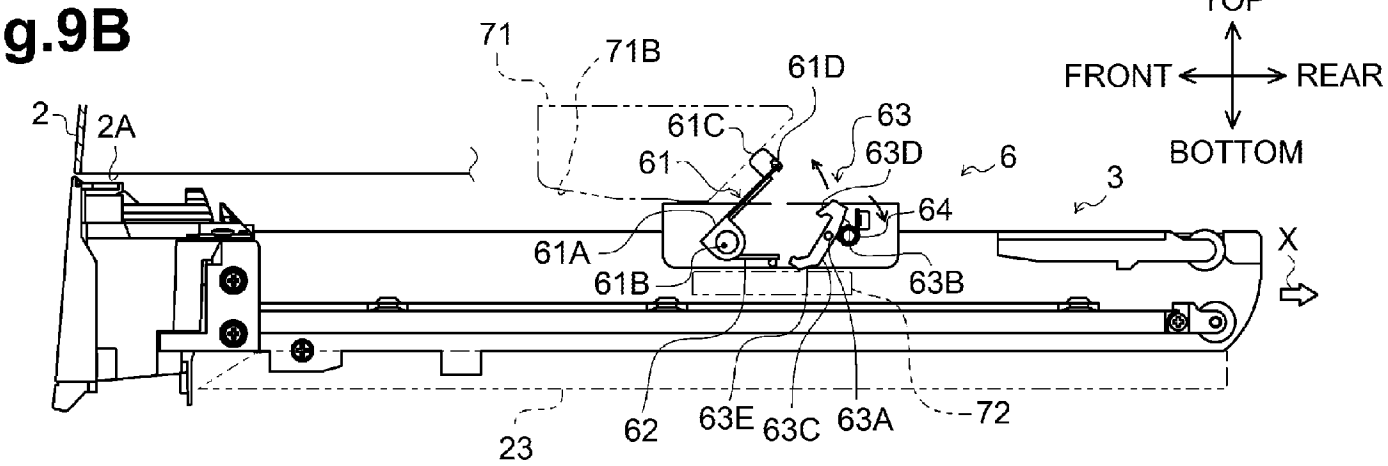
FIG. 9B is a side view of the sheet supply tray that moves in the inserting direction, illustrating a state of the sheet supply tray after the retract assembly reaches the guide mechanism.

More specifically, as the sheet supply tray 3 situated in the installed position, as depicted in FIG. 9B, is manually pulled upstream in the inserting direction (e.g., frontward) or in a removing direction by a user toward the pulled position, the first protrusion 61C of the pushing assembly 61 in the retract assembly 6 is pressed down by the inclined surface 71A of the inclined guide 71, and pivotally moves about the first pivot shaft 61B toward the retracted position.

As depicted in FIG. 11A, as the first protrusion 61C passes through the inclined surface 71A, the pushing assembly 61 moves to the retracted position, and further pressed down from the retracted position. At this time, the inclined surface 63E of the second arm 63 reaches an upstream end portion (e.g., a front end portion) of the upper surface 72A of the protruding guide 72 in the inserting direction.

Thereafter, as the sheet supply tray 3 is moved further in the removing direction, the inclined surface 63E of the second arm 63 slides off the upper surface 72A of the protruding guide 72, as depicted in FIG. 10B, and the second arm 63 moves to the regulating position.

As the sheet supply tray 3 further moves in the removing direction after the second arm 63 moves to the regulating position, the first protrusion 61C of the pushing assembly 61 passes through the third extending surface 71B3 of the inclined guide 71, as depicted in FIG. 10A.

The pushing assembly 61 tends to move to the protruding position by a biasing force of the first spring 62, from a position lower than the retracted position. During the movement, the hook portion 63D situated in the regulating position engages the second protrusion 61D of the pushing assembly 61. Thus, the pushing assembly 61 is held at the retracted position.

Thereafter, as the sheet supply tray 3 is further moved in the removing direction, the sheet supply tray 3 is pulled out completely from the casing 2.

While the disclosure has been described in detail referring to the specific embodiment thereof, this is merely an example, and various changes, arrangements and modifications may be applied therein without departing from the spirit and scope of the disclosure.

What is claimed is:

1. An image forming apparatus comprising:

a casing;

a tray;

a movement mechanism disposed at one of the casing and the tray, wherein the movement mechanism includes:

a first arm assembly including a first arm configured to pivot about a first pivot axis between a retracted position and a protruding position, the first arm being biased toward the protruding position and extending away from the first pivot axis in a first direction when in the retracted position, the first arm comprising an engagement portion; and a second arm configured to rotate between a restriction position in which the second arm engages and contacts the engagement portion of the first arm assembly in the retracted position, and a releasing position in which the second arm is separated from the first arm assembly, the second arm configured to rotate from the restriction position to the releasing position in a direction away from the first arm, the second arm being biased toward the restriction position, wherein the engagement portion of the first arm is biased in a direction away from the second arm; and a guide disposed at the other one of the casing and the tray, the guide including:

a guide surface extending in the first direction, the guide surface configured to contact the first arm situated in the protruding position; and a protruding guide configured to contact and move the second arm, wherein the first arm assembly further includes a first protrusion protruding from the first arm toward the guide surface of the guide in a protruding direction perpendicular to the first direction when the first arm is in the retracted position, wherein the first pivot axis extends in an axial direction perpendicular to the first direction and the protruding direction, wherein the first protrusion is configured to contact the guide surface, and wherein the first protrusion and the engagement portion are disposed on a same side of the first pivot axis in the first direction.

2. The image forming apparatus of claim 1, wherein an end of the first protrusion closest to the guide surface in the protruding direction is disposed closer to a wall than an end of the second arm closest to the guide surface in the protruding direction.

3. The image forming apparatus of claim 1, wherein the second arm is rotatable about a second pivot axis parallel to the first pivot axis, the second arm further comprising:

a regulating arm extending from the second pivot axis and configured to engage the first arm; and a contact arm extending from the second pivot axis in an opposite direction to the regulating arm, the contact arm configured to contact the protruding guide.

4. The image forming apparatus of claim 3, wherein the engagement portion of the first arm assembly includes a second protrusion protruding from the first arm toward the guide surface in the protruding direction, the second protrusion contacting the regulating arm when the first arm is in the retracted position and the second arm is in the restriction position, and wherein an end of the first protrusion closest to the guide surface in the protruding direction is disposed closer to the guide surface than an end of the second protrusion closest to the guide surface in the protruding direction.

5. The image forming apparatus of claim 4, wherein the first protrusion and the second protrusion are integrally formed with the first arm.

6. The image forming apparatus of claim 4, wherein the guide surface has an inclined surface angled relative to the first direction, the inclined surface extending in the protruding direction from an upstream side toward a downstream side in the first direction, the inclined surface contacting the first arm assembly when the first arm is in the protruding position.

7. The image forming apparatus of claim 6, wherein the guide surface further comprises an extending surface extending from the inclined surface toward the upstream side in the first direction, the extending surface configured to contact the first protrusion so as to move the first arm downwardly, and wherein a dimension of moving the first arm assembly downwardly when the first protrusion contacts the extending surface is larger than a protruding amount of the second protrusion.

8. The image forming apparatus of claim 1, wherein a biasing force applied to the second arm is weaker than a biasing force applied to the first arm.

9. The image forming apparatus of claim 1, wherein the casing further comprises a rail extending in the first direction, the rail configured to guide the tray, and wherein the guide is situated above the rail in the casing and the movement mechanism is situated at the tray.

10. The image forming apparatus of claim 1, wherein the tray comprises a lift plate configured to pivot about a third pivot axis, the third pivot axis situated at a downstream side of the lift plate in the first direction.

11. An image forming apparatus comprising:

a casing;

a tray movable from a first position to a second position in a first direction, wherein the tray is disposed farther in the casing, in the first direction, when in the second position than when in the first position;

a movement mechanism disposed at one of the casing and the tray, wherein the movement mechanism includes:

a first arm assembly including a first arm configured to pivot about a first pivot axis, situated closer to an upstream end, in the first direction, of the first arm than to a downstream end, in the first direction, of the first arm, between a retracted position and a protruding position, the first arm being biased toward the protruding position; and a second arm configured to pivot about a second pivot axis between a restriction position in which the second arm engages the downstream end of the first arm in the retracted position, and a releasing position in which the second arm is separated from the first arm assembly, the second arm being biased toward the restriction position, wherein the downstream end of the first arm is biased in a direction away from the second arm; and a guide disposed at the other one of the casing and the tray, the guide including:

a guide surface extending in the first direction; and a protruding guide protruding in a direction perpendicular to the first direction, wherein, when the tray is in the first position, the protruding guide positions the second arm in the releasing position, the first arm being released to the protruding position, wherein the first arm contacts and biases the guide surface when the first arm is in the protruding position, wherein the first arm assembly comprises a first protrusion protruding from the first arm toward the guide surface of the guide in a protruding direction perpendicular to the first direction when the first arm is in the retracted position, wherein the first pivot axis extends in an axial direction perpendicular to the first direction and the protruding direction, wherein the first protrusion is configured to contact the guide surface, and wherein the first protrusion and the downstream end of the first arm are disposed on a same side of the first pivot axis in the first direction.

12. The image forming apparatus of claim 11, wherein the first protrusion protrudes from the downstream end of the first arm.

13. The image forming apparatus of claim 11, wherein the second pivot axis is parallel to the first pivot axis, the second arm further comprising:

a regulating arm extending from the second pivot axis and configured to engage the first arm; and a contact arm extending from the second pivot axis in an opposite direction to the regulating arm, the contact arm configured to contact the protruding guide.

14. The image forming apparatus of claim 13, wherein the first arm assembly further comprises a second protrusion protruding from the first arm toward the guide surface in the protruding direction, the second protrusion contacting the regulating arm when the first arm is in the retracted position and the second arm is in the restriction position, and wherein an end of the first protrusion closest to the guide surface in the protruding direction is disposed closer to the guide surface than an end of the second protrusion closest to the guide surface in the protruding direction.

15. The image forming apparatus of claim 14, wherein the first protrusion and the second protrusion are integrally formed with the first arm.

16. The image forming apparatus of claim 13, wherein the guide surface has an inclined surface angled relative to the first direction, the inclined surface extending in the protruding direction from an upstream side toward a downstream side in the first direction, the inclined surface contacting the first arm assembly when the first arm is in the protruding position.

17. The image forming apparatus of claim 11, wherein an upstream portion of the protruding guide is disposed upstream, in the first direction, of an upstream end of the guide surface.

18. An image forming apparatus comprising:

a casing;

a tray movable from a first position to a second position in a first direction, wherein the tray is disposed farther in the casing, in the first direction, when in the second position than when in the first position;

a movement mechanism disposed at one of the casing and the tray, wherein the movement mechanism includes:

a first arm assembly including a first arm configured to pivot about a first pivot axis between a retracted position and a protruding position and a first protrusion extending, in a protruding direction perpendicular to the first pivot axis, from a distal end of the first arm relative to the first pivot axis in the first direction, the first arm being biased toward the protruding position; and a second arm configured to pivot about a second pivot axis between a restriction position in which the second arm restricts the first arm assembly to the retracted position, and a releasing position in which the second arm allows the first arm assembly to move to the protruding position, the second arm being biased toward the restriction position, wherein the first protrusion of the first arm assembly is biased in a direction away from the second arm; and a guide disposed at the other one of the casing and the tray, the guide including:

a guide surface extending in the first direction; and a protruding guide protruding in a direction perpendicular to the first direction, wherein, when the tray is in the first position, the protruding guide positions the second arm in the releasing position, the first arm being released to the protruding position, wherein the first arm contacts and biases the guide surface when the first arm is in the protruding position, wherein the first protrusion either contacts the second arm when the first arm assembly is in the retracted position or contacts the guide surface when the first arm assembly is in the protruding position, and wherein the first arm assembly further comprises a second protrusion protruding from the first arm toward the guide surface in the protruding direction and the second protrusion contacts the first protrusion in an axial direction of the first pivot axis, the second protrusion contacting the second arm when the first arm is in the retracted position and the second arm is in the restriction position.

19. The image forming apparatus of claim 18, wherein the first protrusion and the second arm overlap in the protruding direction when the first arm is in the retracted position and the second arm is in the restriction position.

20. The image forming apparatus of claim 18, wherein an end of the first protrusion closest to the guide surface in the protruding direction is disposed closer to the guide surface than an end of the second protrusion closest to the guide surface in the protruding direction.

21. The image forming apparatus of claim 18, wherein the first pivot axis and the second pivot axis extend in the axial direction, the second arm further comprising:

a regulating arm extending from the second pivot axis and engaging the first arm when the first arm is in the retracted position and the second arm is in the restriction position; and a contact arm extending from the second pivot axis in an opposite direction to the regulating arm, the contact arm contacting the protruding guide when the tray is in the first position.

22. The image forming apparatus of claim 18, wherein an upstream portion of the protruding guide is situated upstream of an upstream end of the guide surface.

23. The image forming apparatus of claim 18, the second arm configured to rotate from the restriction position to the releasing position in a direction away from the first arm.

* * * * *